United States Patent [19]

Tarlow et al.

[11] Patent Number: 4,819,815

[45] Date of Patent: Apr. 11, 1989

[54] CONTAINER DISPLAY STAND AND CONTAINERS THEREFORE

[75] Inventors: Kenneth A. Tarlow, Playa del Rey, Calif.; Barbara D. Arner, 1901 Polaris Dr., Glendale, Calif. 91208

[73] Assignee: Barbara D. Arner, Oxnard, Calif.

[21] Appl. No.: 170,061

[22] Filed: Mar. 15, 1988

Related U.S. Application Data

[63] Continuation-in-part of Ser. No. 44,962, May 1, 1987, abandoned.

[51] Int. Cl.[4] ..... A47B 73/00

[52] U.S. Cl. ..... 211/74; 215/314; 222/553

[58] Field of Search ..... 211/59.2, 74, 75, 76, 211/128, 84, 83; 206/828; 220/23.4, 23.86, 23.83; 312/129, 130, 72, 35, 45; 215/314; 222/553, 181, 185, 545

[56] References Cited

U.S. PATENT DOCUMENTS

| | | | |
|---|---|---|---|
| 1,725,689 | 8/1929 | Witt | 222/553 |
| 2,361,047 | 10/1944 | Morey | 222/553 |
| 2,580,676 | 1/1952 | Gross | 211/75 |
| 3,259,445 | 7/1966 | Saxon | 211/75 X |
| 3,650,381 | 3/1972 | Weindling | 211/195 X |
| 3,814,293 | 6/1974 | Daves | 211/74 X |
| 3,964,709 | 6/1976 | LaBelle et al. | 211/74 X |
| 4,001,444 | 1/1977 | Clarke | 211/74 X |
| 4,350,253 | 9/1982 | Rusteberg | 211/74 |
| 4,378,889 | 4/1983 | Lebowitz | 211/74 X |
| 4,632,362 | 12/1986 | Lucking | 222/553 |

*Primary Examiner*—J. Franklin Foss
*Assistant Examiner*—Sarah A. Eley Lechok
*Attorney, Agent, or Firm*—Poms, Smith, Lande & Rose

[57] ABSTRACT

A container display stand and containers therefore is provided including an upright display stand having a plurality of spaced apertures extending through the stand from the front to rear thereof. These apertures are angled downwardly and a container is disposed in one or more of the apertures extending therethrough from the front to rear thereof. Each container comprises a jar having a threaded neck. A flanged insert has one end threaded to the neck and the other end extending through the opening. A flange separates the ends and abuts against the rear side of the stand. A cap is threaded on to the protruding other end of the insert extending through the opening, the cap having a flange abutting against the front side of the stand thereby securing the containers in the apertures. The cap has a semi-circular opening presenting a closed portion at the bottom with an open portion at the top selectively closed by a semi-circular closure member. The closure member is movable about the semi-circular portion of the cap to either close off the semi-circular opening or open the same. Since the containers are tilted in the apertures, the contents thereof move toward the semi-circular opening allowing the closure member to be opened to select the contents of the container as desired.

8 Claims, 3 Drawing Sheets

Fig. 7.
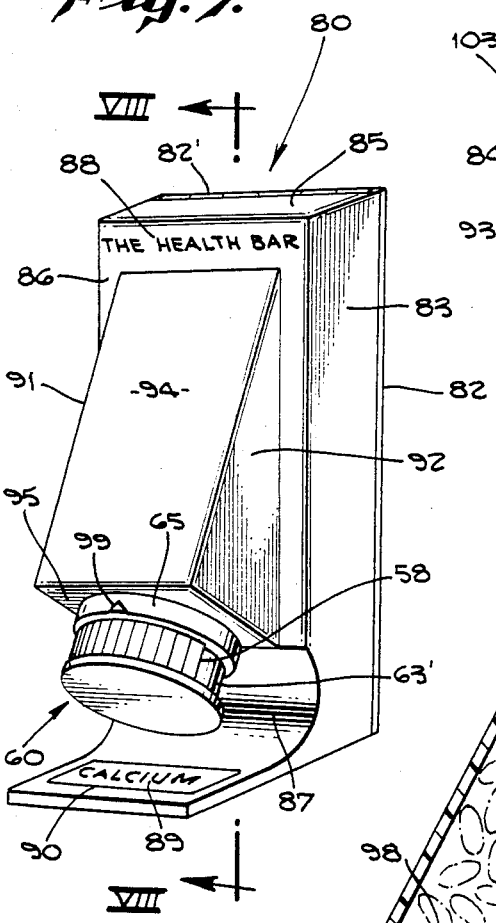
Fig. 9.
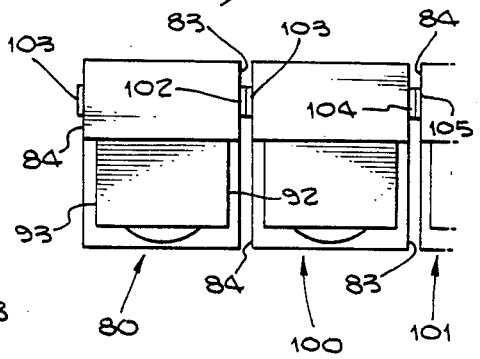
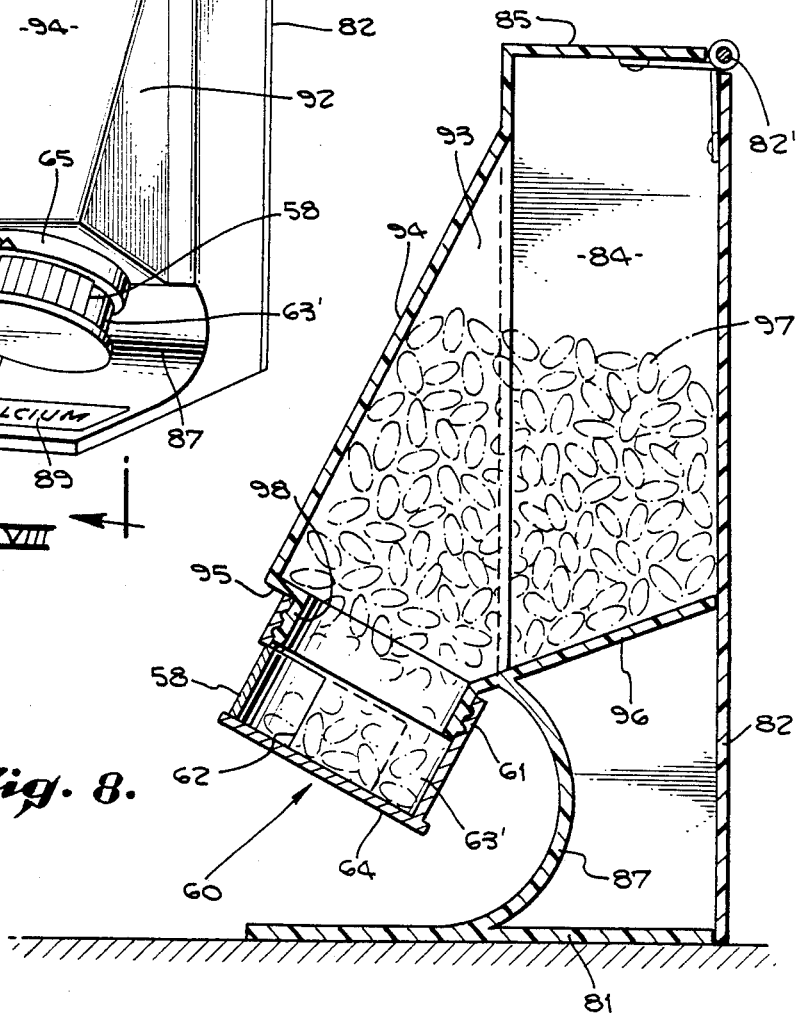
Fig. 8.

CONTAINER DISPLAY STAND AND CONTAINERS THEREFORE

This is a continuation-in-part of prior complete application Ser. No. 07/044,962 now abandoned, filed on May 1, 1987.

BACKGROUND OF THE INVENTION

1. Field of the Invention

The invention relates to display stands and containers therefore; and, more particularly, to a stand displaying a plurality of containers allowing the contents to be selected therefrom as desired.

2. Description of the Prior Art

There has been increased emphasis on good health and nutrition in recent years. The presence of certain vitamins and minerals in one's diet has been long recognized. Many people take a number of different vitamins and minerals every day. As a general rule, such a person would have a plurality of bottles containing the different vitamins and minerals scattered about a counter or the like. The user must pick up the bottles one by one to see what vitamins or minerals he or she wants, unscrew the cap and replace the cap after taking one or more capsules or tablets out of the bottles.

Obviously, such a procedure is not very efficient and not very orderly. There is thus a need for a display rack or the like which allows one to determine quickly and easily those vitamins or minerals he or she desires to take in a neat and orderly manner. Various types of pill dispensers and the like are known in the art. These dispensers are individual units used to dispense pills or the like one at a time. Thus, no arrangement is known holding a plurality of containers for dispensing pills, capsules or tablets in a quick, easy, neat and orderly manner and one that automatically dispenses a pill, capsule or tablet when the container is opened.

SUMMARY OF THE INVENTION

It is an object of this invention to provide a display stand for displaying a plurality of containers and presenting the contents thereof for quick and easy selection.

It is a further object of this invention to provide a container having a selectively closable opening about the neck thereof particularly useful in the display stand in accordance with the foregoing object.

It is still further and object of this invention to provide a vitamin and mineral display stand wherein the contents of the containers containing the vitamins and minerals are visible and the containers can be quickly and easily opened to dispense the contents thereof.

These and other objects are preferably accomplished by providing a container display stand including an upright display stand having a plurality of spaced apertures extending through the stand from the front to rear thereof. These apertures are angled downwardly and a container is disposed in one or more of the apertures extending therethrough from the front to rear thereof. Each container comprises a jar having a threaded neck. A flanged insert has one end threaded to the neck and the other end extending through the opening. A flange separates the ends and abuts against the rear side of the stand. A cap is threaded on to the protruding other end of the insert extending through the opening, the cap having a flange abutting against the front side of the stand thereby securing the containers in the apertures. The cap has a semi-circular opening presenting a closed portion at the bottom with an open portion at the top selectively closed by a semi-circular closure member. The closure member is movable about the semi-circular portion of the cap to either close off the semi-circular opening or open the same. Since the containers are tilted in the apertures, the contents thereof move toward the semi-circular opening allowing the closure member to be opened to select the contents of the container as desired.

The containers can be transparent so that the contents are visible at the rear of the stand.

BRIEF DESCRIPTION OF THE DRAWING

FIG. 7 is a perspective view of another embodiment of a single container in accordance with the invention;

FIG. 8 is a view taken along lines VIII—VIII of FIG. 7; and

FIG. 9 is a perspective view of a plurality of the containers of FIG. 7 mounted in a side-by-side relationship.

DESCRIPTION OF THE PREFERRED EMBODIMENT

Figure 1:
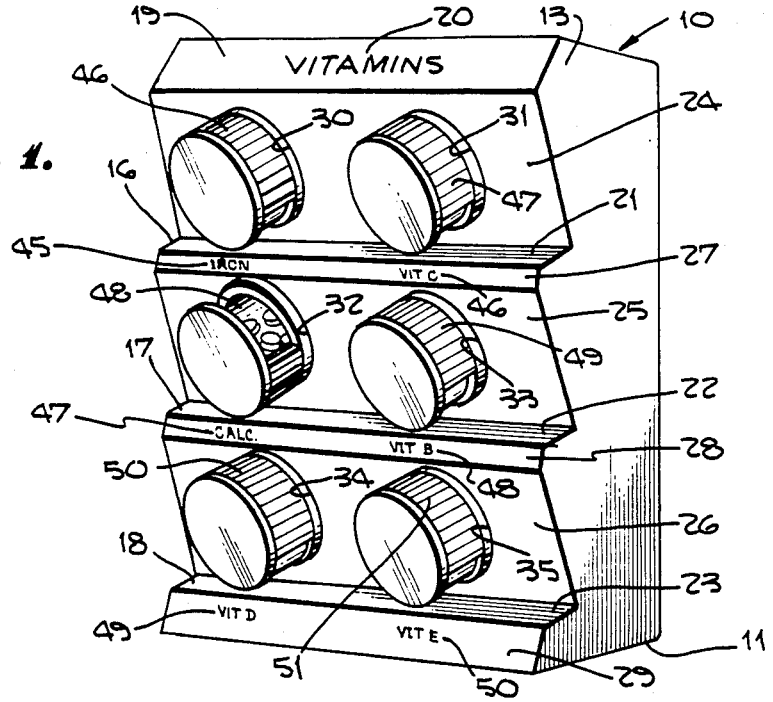
FIG. 1 is a perspective view of a display stand in accordance with the teachings of the invention.
Figure 2:
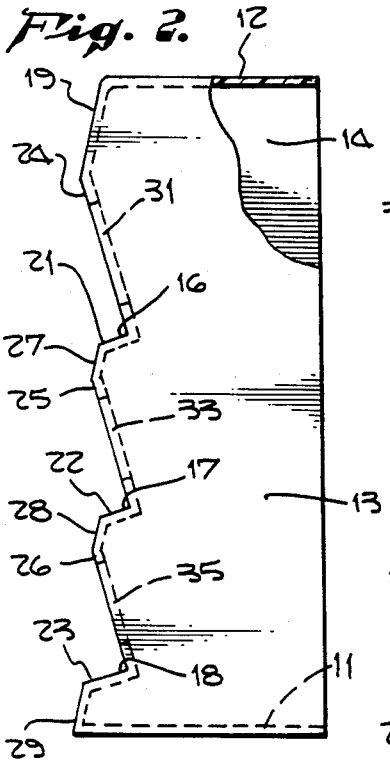
FIG. 2 is a vertical side view, partly in section, of the stand alone of FIG. 1.
Figure 3:
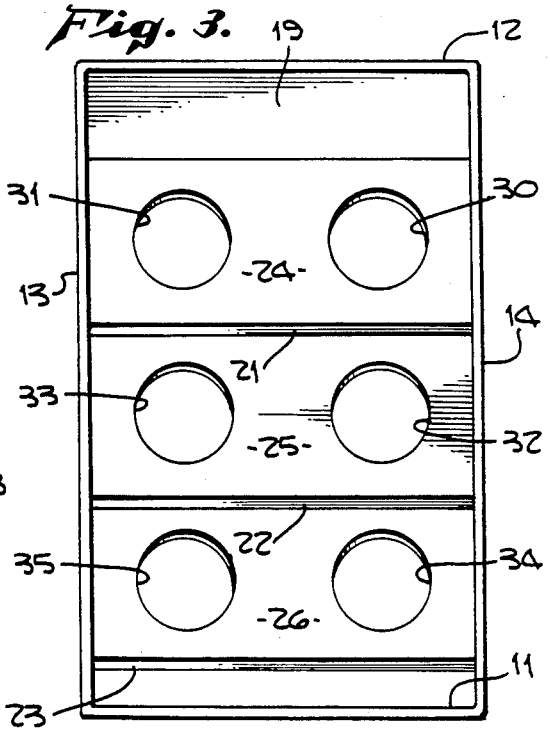
FIG. 3 is a vertical rear view of the stand alone of FIG. 1.

Referring now to FIG. 1 of the drawing, a display stand 10 is shown having a base 11, a top wall 12, a pair of side walls 13, 14 (see FIG. 2) interconnecting base 11 with top wall 12.

As seen in FIG. 1, top wall 12 slopes downwardly at sloped portion 19 and indicia 20, such as the word VITAMINS, may be provided thereon. As seen particularly in FIGS. 1 and 2, each side wall, 13, 14 extends from sloped portion 19 downwardly and inwardly, then outwardly to form a first ledge support portion 16, then curves downwardly therefrom and inwardly, then back outwardly to form a second ledge support portion 17, then again curving downwardly and inwardly, then finally outwardly (to form third ledge support portion 18) and down to bottom wall 11.

These ledge support portions 16 to 18 at each side wall 13, 14 support ledges 21 to 23, respectively, extending across the front of stand 10. A front wall portion 24 through 26 is associated with each ledge 21 to 23, respectively, closing off the stand 10 (front wall portion 24 extending from sloped portion 19 to ledge 21 and its downwardly sloped portion 27, front wall portion 25 extending from sloped portion 27 to ledge 22 and its downwardly sloped portion 28 and front wall portion 26 extending from sloped portion 28 to ledge 23 and its downwardly sloped portion 29 which extends to and is connected to bottom wall 11).

The foregoing has described a stand having a particular arrangement of side, rear and front walls but obviously any suitable arrangement may be used. Also, any suitable materials may be used. For example, the stand 10 may be made of metal, wood or plastic parts, screwed or glued or otherwise adhered together. Alternatively, the entire stand may be molded of one piece of material, such as plastic, with the apertures to be discussed simultaneously molded therein.

Thus, as seen in FIG. 1, a pair of spaced openings 30, 31 are provided in front wall portion 24. A like pair of spaced openings 32, 33 are provided in front wall portion 25. A like pair of spaced openings 34, 35 are provided in front wall portion 26.

The interior as seen in FIG. 1, for sake of uniformity, the openings 30, 32, 34 form one vertical row and openings 31, 33 and 35 form a second vertical row spaced from the first vertical row. The plane of the openings 30 to 35 are angled so that a line passing through the center thereof forms an angle of about 30° with the horizontal for reasons to be discussed.

As seen in FIG. 1, additional indicia may be provided on each sloped portion 27 to 29, such as indicia 45, 46 on sloped portion 27; indicia 47, 48 on sloped portion 28 and indicia 49, 50 on sloped portion 29. This indicia can identify the contents of the containers in each aperture of the stand 10, such as IRON, VIT-C, etc.

As seen in FIG. 1, a container, such as containers 46 to 51, is disposed in each opening 30 to 35, respectively, in stand 10.

Figures 4, 5, 6:
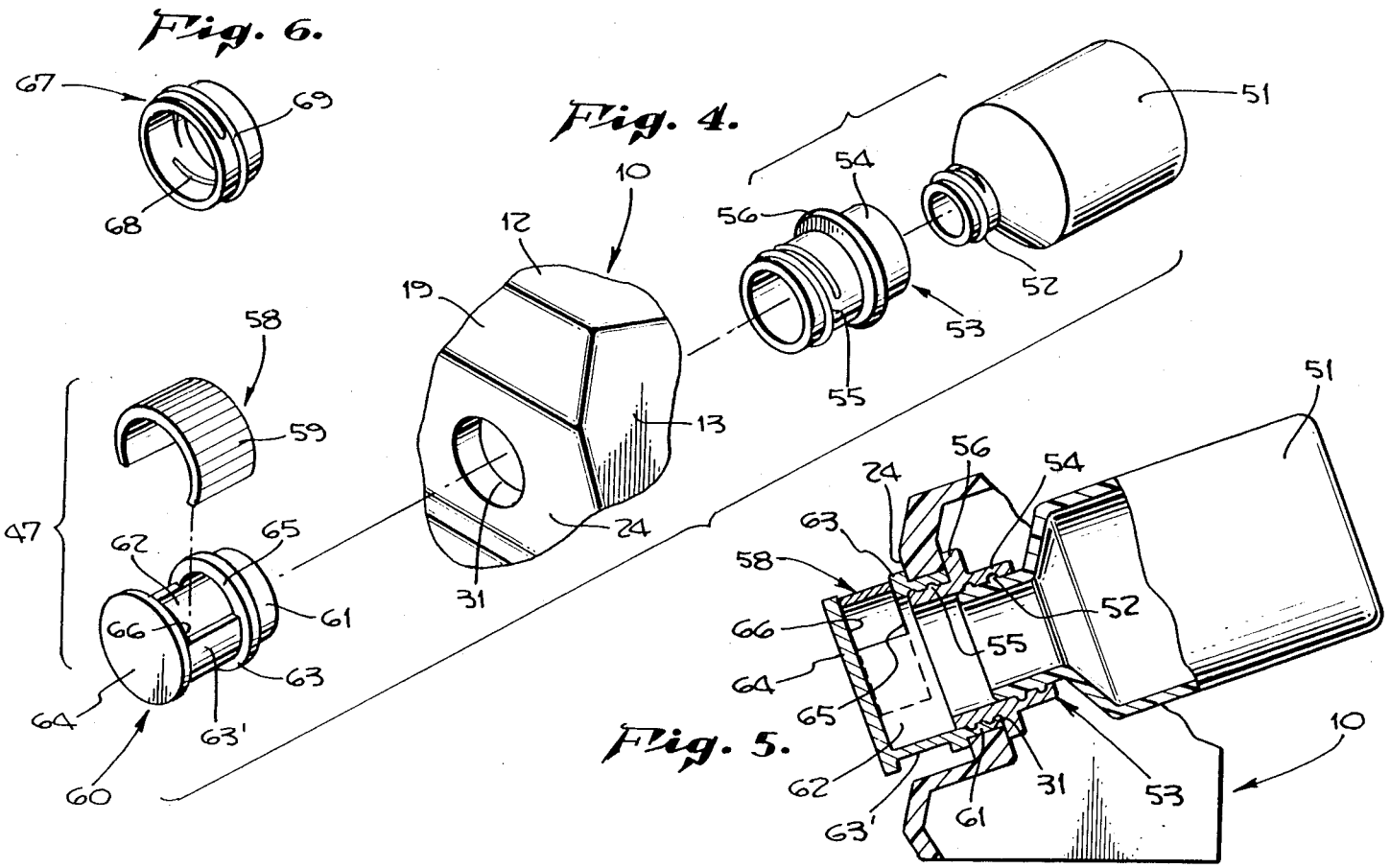
FIG. 4 is an exploded view showing one of the containers of the stand of FIG. 1, and a portion of the stand, prior to assembly thereto.
FIG. 5 is a view partly in section of a portion of the combination of FIG. 1.
FIG. 6 is a perspective view of an adapter useful in the container of FIGS. 1–5.

One of the containers, such as container 47, is shown in exploded view in FIG. 4 prior to assembly in stand 10. Each container, container 47 being exemplary, is comprised of a main body portion 51, such as a closed jar, having a reduced threaded neck portion 52. An insert member 53 is provided having an inwardly threaded collar 54 at one end adapted to threadably engage neck portion 52 and an outwardly threaded portion 55 at the other end separated by an annular flange 56.

In assembly, end portion 54 is threaded to neck portion 52 of jar 51 (FIG. 5) with flange 56 abutting against the rear portion of wall 24 and end threaded portion 55 extends through opening 31 in the rear portion of wall 24.

As seen in FIG. 4, container 47 also includes a front closure member comprised of a curved cover 58, which may be ribbed on the outer surface 59, and a main body portion 60 having an inwardly threaded portion 61 adapted to threadably engage end portion 55 of insert member 53 (see FIG. 5) and an open front portion 62 interconnected thereto separated by an annular flange 63 adapted to abut against front wall portion 24 (FIG. 5). Front portion 62 has a lower curved wall 63, and is open at the top (forming a curved opening defined by side flanges 65, 66—see FIG. 5) and closed off at the front by a circular plate 64. Cover 58 is adapted to snap fit onto side flange 65, 66 and rotates over the outer surface of lower curved wall 63' as seen in FIG. 1 (as in container 48). This is easily accomplished by making parts 58 and 60 of plastic; however, any suitable means may be provided for selectively opening each container so that the contents therein are visible and accessible. In addition, such means should present the contents to view and accessibility yet be sufficient to close each container to keep the contents fresh and free from contamination. Thus, as seen in FIG. 1, cover 58 on container 48 can be quickly and easily rotated and one of the capsules therein can be selected.

Generally, the jars 51 are preferably state-of-the-art vitamin and mineral containers of a standard size. Of course, the desired type jar and threaded neck portion may be provided by either the user of the stand or by the manufacturer thereof. For example, if jars 51 are not provided by the manufacturer and the user's jars did not threadably mate with insert members 53, an adapter, such as adapter 67 (FIG. 6) may be provided. Adapter 67 may be internally threaded at end 68 to engage a larger diameter threaded neck portion of a jar and have an externally threaded portion 69 at the other end of a diameter sufficient to thread into end portion 54 of insert member 53 (FIG. 4).

Since the apertures are angled, the contents of each container tilt to the front so that the capsules, pills or tablets are readily accessible when cover 58 is rotated to expose the interior thereof. The body portion or jar 51 may be transparent, as of transparent glass or plastic, and, thus, the contents therein are visible through the jar 51 protruding on the rear of stand 10. The contents of each container may be clearly identified by suitable indicia which may be labels or inserts that can be changed as desired.

Although a plurality of fixed interconnected containers may be provided, as set forth in FIGS. 1 to 6, individual stand alone containers, such as container 80 (FIG. 7) may be provided, adapted to be mounted in a side-by-side relationship as seen in FIG. 9. The container 80 has a bottom wall 81, (FIG. 8), an upstanding rear wall 82, hinged at spring hinge 82' so that it can be opened to fill the interior of container 80, a pair of upstanding side walls 83, 84 (see also FIG. 7) and a top wall 85. The front of container 80 is closed off by a upper flat front wall 86 (see FIG. 7) extending down to a curved bottom front wall portion 87. Indicia 88 may be provided at the top of wall 86 of container 80 to refer to the type of container; further indicia 89 may be provided at the bottom on curved wall portion 87, in the form of a removable label 90, to refer to the contents of container 80.

As clearly seen in FIG. 7, a vitamin or pill container box 91 protrudes at an angle from wall 86. Box 91 has a pair of side walls 92, 93 (see also FIG. 9) closed off at the front by a downwardly sloping front wall 94. The side walls 92, 93 and front wall 94 are closed off at the bottom by bottom wall 95.

Wall 94 may be a continuation of wall 86 and the interior of container 80 may have a sloped partition wall 96 so that the entire interior of container 80, above wall 96, can be filled with pills or vitamins 97. The sloped wall 96, and the angle of tilt to container 80, moves the pills or vitamins 97 downwardly by gravity to the bottom opening of container 80 which is defined by cylindrical ribbed wall 98 of an outer diameter generally related to the inner diameter of cylindrical cap 60. Cap 60 is threaded to wall 98 and is identical to cap 60 of the embodiments of FIGS. 1 to 6 with a similar ribbed curved cover 58. Thus, like numerals refer to like parts of the cap 60 of FIGS. 1 to 6 and further description is deemed unnecessary. However, indicia 99 (FIG. 7) may be provided on flange 65 to align cap 60 with generally the middle of wall 94 so that the opening 62 in cap 60 (see FIG. 4) is properly oriented. Also, if desired, the insert 67 of the embodiment of FIG. 6 may be provided to enable one to use a uniform diameter cap with various sized openings. Although cap 60 shows grooves on portion 61 threading to ribs on portion 98, such mating ribs and groove may be eliminated, if desired, with cap 60 press fit onto portion 55 (in FIG. 5) or wall 98 in FIG. 8.

The angularity of container 80 is such that a line passing through the center of the opening defined by wall 98 parallel to the wall 94, makes an angle of about 30° with respect to the vertical.

As seen in FIG. 9, containers 100, 101 identical to container 80, may be disposed in a side-by-side abutting relationship. Any number of such containers may be used. Also, such containers 80, 100 and 101 may be free-standing or removably interconnected, such as by mating magnets 102, 103 (interconnecting containers 80, 100) and mating magnets 104, 105 (interconnecting containers 100, 101). Of course, any suitable releasable interconnection means may be used.

It can be seen that we have disclosed a stand and container therefore particularly suitable to displaying vitamins and minerals or other pharmaceuticals and presenting such for easy accessibility in a neat and orderly manner.

We claim:

1. A combination display stand and container comprising:

a stand having a bottom wall, a rear wall connected to the bottom wall and an upstanding front wall spaced from said rear wall extending upwardly from said bottom wall;

a plurality of spaced and downwardly angled aligned apertures extending through the front and rear walls, said apertures having a plane at an angle so that a line passing through the center thereof is an angle with the horizontal;

at least one container adapted to contain a plurality of discrete pellets therein disposed in at least one downwardly angled aligned set of said apertures extending through the front and rear wall of said stand, each of said containers having a jar portion with a threaded neck portion with said threaded neck portion disposed at the lower end of said container where said container extends through the front wall of said stand, an insert member having a first end threaded to said threaded neck portion and a second threaded end extending into the aperture from the rear wall of said stand, a flange member separating said first end from said second end and abutting against the rear wall of said stand, a closure member normally closing off the neck portion of said jar portion having a first end extending into said aperture and threadably engaging the second end of said insert member, a flange member separating the first end of said closure member from a second end thereof having an opening leading into the interior of said closure member, said last-mentioned flange member abutting against said front wall of said stand and closure means associated with the opening leading into the interior of said closure member for selectively opening and closing the same, said closure member including an imperforate curved bottom wall and the opening leading into the interior thereof includes an open top portion defined by spaced curved side flanges, said closure means including a curved cover plate encircling said curved bottom wall in a first position thereby exposing said open top portion and reciprocal over said side flanges to close off said open top portion in a second position whereby, when said curved cover plate is reciprocated over said side flange to expose said open top portion, any pellets in said container, having moved by gravity to said neck portion, are selectively removable from said container through said open top portion.

2. In the combination of claim 1 including indicia on said stand associated with each of said apertures.

3. In the combination of claim 1 wherein said line passing through the center of said apertures makes an angle of about 30° with respect to the horizontal.

4. A combination display stand and container for dispensing a plurality of solid discrete pellets therefrom comprising:

a stand having a bottom wall, a rear wall, interconnecting spaced side walls and an upstanding front wall extending from said bottom wall, an aperture extending through the front wall;

a chamber disposed in the interior of said stand and having a portion extending outwardly and downwardly from said front wall through the aperture therein, said chamber portion being at an angle with respect to said front wall so that a line passing through the center thereof and into the interior of said stand is at an angle with the horizontal, terminating at a neck portion, a closure member normally closing off said neck portion having a first end engaging said neck portion, a flange member separating the first end of said closure member from a normally closed portion thereof, and closure means associated with said closed portion for selectively opening and closing said closed portion, said closure member, including an imperforate curved bottom wall and an open top portion defined by spaced curved side flanges, said closure means including a curved cover plate encircling said curved bottom wall in a first position thereby exposing said open top portion and reciprocal over said side flanges to close off said open top portion in a second position, whereby, when a plurality of discrete pellets are disposed inside of said chamber, said pellets will fall by gravity to said neck portion whereby said pellets can be selectively removed from said neck portion upon selective reciprocation of said cover plate to open and close said open top portion.

5. In the combination of claim 4 including indicia on said stand associated said aperture.

6. In the combination of claim 4 wherein said line passing through the center of said chamber portion makes an angle of about 30° with respect to the horizontal.

7. In the combination of claim 4 wherein said front wall includes a portion extending downwardly curving first inwardly then downwardly and outwardly to said bottom wall.

8. In the combination of claim 4 including first magnetic means on one of said side walls and second magnetic means on the other of said side walls, said first and second magnetic means being magnetically attractive.

* * * * *